United States Patent [19]

von Beckmann

[11] Patent Number: 4,489,658

[45] Date of Patent: Dec. 25, 1984

[54] BALLAST SHOULDER CONSOLIDATOR

[76] Inventor: Helmuth von Beckmann, 189 Castle Rd., Columbia, S.C. 29210

[21] Appl. No.: 401,987

[22] Filed: Jul. 26, 1982

[51] Int. Cl.[3] ..... E01B 27/02

[52] U.S. Cl. ..... 104/12; 37/105; 37/DIG. 18; 404/96; 404/105

[58] Field of Search ..... 37/105, DIG. 18; 104/10, 12; 404/96, 97, 98, 105

[56] References Cited

U.S. PATENT DOCUMENTS

| | | | |
|---|---|---|---|
| 2,909,970 | 10/1959 | Jackson | 404/96 X |
| 3,149,579 | 9/1964 | Plasser et al. | 104/12 X |
| 3,445,944 | 5/1969 | Speno | 404/96 X |
| 3,589,296 | 6/1971 | Plasser | 104/12 |
| 3,651,762 | 3/1972 | Plasser et al. | 104/12 |
| 3,675,581 | 7/1972 | Plasser et al. | 104/12 |
| 3,682,101 | 8/1972 | Plasser et al. | 104/12 |
| 3,965,822 | 6/1976 | Stewart | 104/12 X |
| 4,075,853 | 2/1978 | de Larosiere de Champfeu | 404/105 X |
| 4,111,129 | 9/1978 | von Beckmann | 104/12 |

FOREIGN PATENT DOCUMENTS

| | | |
|---|---|---|
| 1263240 | 2/1972 | United Kingdom . |
| 1398872 | 6/1975 | United Kingdom . |

*Primary Examiner*—Robert B. Reeves
*Assistant Examiner*—David F. Hubbuch
*Attorney, Agent, or Firm*—Wenderoth, Lind & Ponack

[57] ABSTRACT

A railway track working machine is provided with a vibratory ballast surface compactor. The compactor has a top ballast engaging plate and a second ballast engaging plate arranged to work in association with top ballast plate (hinged or otherwise) along an outer longitudinal edge of the top plate. The top plate has a leading edge and a trailing edge and a ballast compacting under-surface, the leading edge being wider in a direction tranversely of the track than the trailing edge and the compactor is mounted so as to present, in ballast compacting operation, the top plate leading edge at a higher level above the ballast surface than the trailing edge, the under-surface of the top plate sloping rearwardly in the direction of track working from the leading edge to the trailing edge. The trailing edge is adjusted, in operation, so as to be located at a selected level for ballast compaction.

3 Claims, 1 Drawing Figure

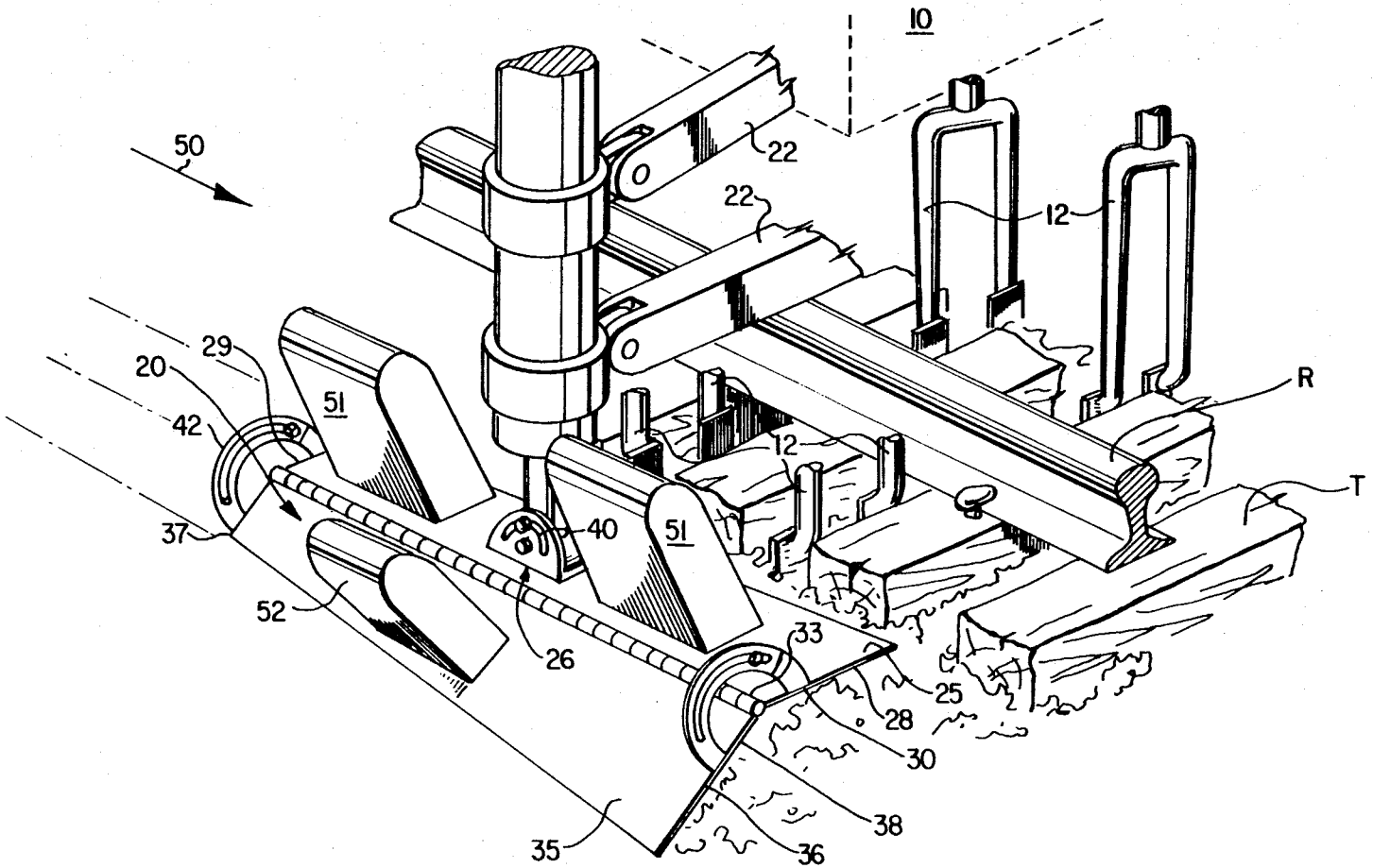
10
12
12
12
R
T
22
22
25
28
30
33
36
38
35
26
40
51
51
52
29
20
42
37
50

BALLAST SHOULDER CONSOLIDATOR

BACKGROUND OF THE INVENTION

This invention relates to railroad track working machines of the type which have a vibratory ballast surface compactor, such as a compactor suitable for ballast shoulder consolidation.

Vibratory ballast surface compactors, suitable for consolidating a ballast shoulder are well known in the art, see for example U.S. Pat. No. 3,589,296; U.S. Pat. No. 3,651,762; U.S. Pat. No. 3,682,101; British Pat. No. 1,263,240; and British Pat. No. 1,398,872.

One of the problems which these shoulder consolidating devices have encountered, particularly shoulder consolidators which are utilized with a continuously moving track working machine, has been a tendency to overcompact the shoulders, exposing the tie ends. A second problem, resulting in the overcompaction of the ballast shoulders, has been a tendency for the compactor blades to dig into the ballast and consequently be buried in the course of forward movement. Another problem is that present surface compactors have to be retracted periodically through the entire stroke required to provide adequate consolidation; such operation is not conducive to uniform compaction.

Applicant seeks to reduce the problem of overcompaction and the tendency for the compactor blade to dig into the ballast, and to secure more uniform compaction by providing a revised configuration of compactor.

SUMMARY OF THE INVENTION

According to the present invention there is provided a railroad track-working machine comprising a vibratory ballast surface compactor mounted on the machine, the compactor having a top ballast-engaging plate means; the top plate means has a leading edge, a trailing edge and a ballast compacting under-surface; the top plate being mounted so as to present, in ballast compacting operation, a leading edge which is higher above the ballast surface than the trailing edge, the under-surface is arranged to slope rearwardly in the direction of track working from the leading edge to the trailing edge; and the trailing edge is located, in operation, at a selected level for proper ballast compaction.

Preferably, a second ballast engaging plate means is operatively connected to the top plate means along an outer longitudinal edge thereof.

Preferably also, the leading edge of top plate means is wider, transversely of the track, than its trailing edge. In a preferred feature of the invention, means is provided to vary the height of the leading edge of the top plate, relative to its trailing edge, above the ballast.

Conveniently, the second ballast engaging plate means has a leading edge, a trailing edge and a ballast compacting inner-surface, the leading edge of the second ballast engaging plate means being wider, transversely of the track, than its trailing edge.

Preferably the second plate means is hinged to the top plate means along the outer longitudinal edge of the top plate means and means is provided for rotating at least one of the plate means relative to the other, about the hinge connection.

The funnel-type apparatus is especially useful for a continuously moving machine.

BRIEF DESCRIPTION OF THE DRAWINGS

The following is a description by way of example of one embodiment of the present invention, reference being had to the accompanying drawing which is a schematic illustration of a vibratory ballast surface compactor.

DESCRIPTION OF A PREFERRED EMBODIMENT

A railroad track working machine 10, the frame of which is illustrated by the chain dotted lines, is in this instance, a track tamping machine having conventional track tamping bars 12. The machine 10 could, of course, be a track aligning machine, a track lifting, tamping and aligning machine, a track shoulder compacting machine, or any other suitable form of track working machine.

A vibratory ballast surface compactor 20 is mounted on the machine 10 by means of a parallel linkage 22 of conventional form which connects to hydraulic devices for applying vertical and lateral pressure to the vibratory ballast surface compactor 20 or for positioning it in relation to the desired finished surface elevation of the ballast shoulder. The compactor 20 has a top ballast-engaging plate 25 connected through a mounting, schematically shown at 26, to the linkage 22. The top plate 25 has a leading edge 28 and a trailing edge 29 and a ballast compacting under-surface 30. The leading edge 28 is wider, transversely of the track, that is to say in the longitudinal direction of the ties T, and transversely of the rails R, than the trailing edge 29.

Hingedly connecting along the outer edge 33, of the plate 25 is a second plate 35 having a leading edge 36 and a trailing edge 37 and a ballast compacting inner-surface 38. The leading edge 36 is wider in the direction transversely of the track than is the trailing edge 37. The attitude of the top plate relative to the ballast can be adjusted by suitable means, say, the screw and slot arrangement 40 and in operation the leading edge 28 is always at a greater height above the ballast surface than is the trailing edge 29 so that the under-surface 30 slopes rearwardly in the direction of track working, as shown by arrow 50 and the trailing edge 29 is adjusted by means of the hydraulic linkage 22 so that it is at the selected level for correct ballast compaction, usually level with the tie tops. (In the drawing for the sake of clarity the outer ends of the ties have been over-exposed but normally the ballast would be about level with the tie tops, when compacted). The attitude of the second plate 35 relative to the top plate 28 can be adjusted by any suitable means, say, the screw and slot arrangements 42 so as to rotate the plates 28, 35 relative to each other to adopt an attitude which is desired. Electrical out-of-balance vibratory devices 51 and 52 are mounted on the top and second plates respectively, and in conventional fashion vibrate the plates and as a consequence the ballast when engaged thereby. Ballast compacting pressure is applied through linkage 22 and in operation, and particularly where a "windrow" of ballast has been provided at the shoulder edge, the compactor 20 acts in the form of a funnel with a wider mouth than tail.

With this configuration it is possible to reduce, or entirely remove the tendency for the compactor 20 to dig into the ballast or to overcompact the ballast. Further, it is possible to determine the desired degree of ballast compaction in accordance with its consistency or volume by the adjustments of the relative funnel angles.

What I claim as my invention is:

1. A railroad track-working machine comprising a vibratory ballast surface compactor mounted on the machine, said compactor having a top ballast-engaging plate means and a second ballast-engaging plate means hingedly connected thereto along an outer longitudinal edge thereof; said top plate means having a leading edge, a trailing edge, and a ballast compacting under-surface; said second ballast-engaging plate means having a leading edge, a trailing edge and a ballast compacting inner-surface; the leading edges of said top and second ballast engaging plate means being wider, transversely of the track, than their respective trailing edges; said top plate means being mounted so as to present, in ballast compacting operation, its leading edge at a level higher above the ballast surface than its trailing edge; said under-surface sloping rearwardly in the direction of track working from said top plate leading edge to its trailing edge; means for rotating at least one of said plate means relative to the other, about said hinged connection and means for locating said top plate trailing edge, in operation, at a selected level, for ballast compaction.

2. A railroad shoulder ballast vibratory compactor of generally funnel like configuration operatively mounted on a track working machine comprising a top ballast-engaging plate means having a leading edge, a trailing edge, and a ballast compacting under-surface; said top plate means being mounted so as to present, in ballast compacting operation, a leading edge which is higher above the ballast surface than its trailing edge, said under-surface sloping rearwardly in the direction of track working from said leading edge to said trailing edge; means to positively adjust and secure the height of said leading edge relative to said trailing edge; means to locate, in operation, the position of the trailing edge at a selected level for ballast compaction; and a second ballast-engaging plate means having a leading edge and a trailing edge and a ballast compacting inner-surface; means to adjust the attitude of the second plate means relative to said first plate about an axis generally parallel to a track rail; wherein the leading edge of at least one of the said top and second ballast-engaging plate means is wider, transversely of the track, then its respective trailing edge; whereby on movement of the compactor along the track in a working direction, loosely packed shoulder ballast is engaged by the leading edges of said plate means and firmly compacted within their ballast compacting surfaces by the ballast volume reducing funneling action of said plate means.

3. A compactor as claimed in claim 2 in which the leading edges of both said top and second ballast-engaging plate means are wider, transversely of the track, than their respective trailing edges.

* * * * *